US010363588B2

(12) United States Patent
Shibata et al.

(10) Patent No.: US 10,363,588 B2
(45) Date of Patent: Jul. 30, 2019

(54) EXTRUSION APPARATUS

(71) Applicants: AISIN KEIKINZOKU CO., LTD., Imizu-shi, Toyama (JP); GIKEN CO., LTD., Nomi, Ishikawa (JP)

(72) Inventors: Toshikazu Shibata, Oyabe (JP); Tomohiro Hayashi, Takaoka (JP); Yoshiyuki Futamata, Nonoichi (JP)

(73) Assignees: Aisin Keikinzoku Co., Ltd. (JP); Giken Co., Ltd. (JP)

( * ) Notice: Subject to any disclaimer, the term of this patent is extended or adjusted under 35 U.S.C. 154(b) by 366 days.

(21) Appl. No.: 15/424,156

(22) Filed: Feb. 3, 2017

(65) Prior Publication Data

US 2017/0225210 A1 Aug. 10, 2017

(30) Foreign Application Priority Data

Feb. 4, 2016 (JP) ..... 2016-020320

(51) Int. Cl.

| | |
|---|---|
| ***B21C 23/00*** | (2006.01) |
| ***B21C 29/00*** | (2006.01) |
| ***B21C 33/00*** | (2006.01) |
| ***B21C 35/02*** | (2006.01) |
| ***B21C 35/04*** | (2006.01) |

(52) U.S. Cl.

CPC ..... *B21C 23/00* (2013.01); *B21C 29/003* (2013.01); *B21C 33/00* (2013.01); *B21C 35/02* (2013.01); *B21C 35/04* (2013.01)

(58) Field of Classification Search

CPC ..... B21C 23/00; B21C 29/003; B21C 33/00; B21C 35/02; B21C 35/04

USPC ..... 72/254

See application file for complete search history.

(56) References Cited

U.S. PATENT DOCUMENTS

| | | | | | |
|---|---|---|---|---|---|
| 3,113,676 | A * | 12/1963 | Harkenrider | B21C 33/00 | 72/270 |
| 4,559,854 | A * | 12/1985 | Jurgens | B21C 33/00 | 83/15 |
| 5,165,268 | A * | 11/1992 | Visser | B21C 35/02 | 104/246 |
| 5,201,209 | A * | 4/1993 | Houmura | B21C 35/02 | 72/257 |
| 2017/0225210 | A1 * | 8/2017 | Shibata | B21C 23/00 | |

FOREIGN PATENT DOCUMENTS

JP H10-277635 A 10/1998

* cited by examiner

*Primary Examiner* — David B Jones

(74) *Attorney, Agent, or Firm* — Harness, Dickey & Pierce, P.L.C.

(57) ABSTRACT

An extrusion apparatus includes an extruder, a run-out table that supports an extruded material that has been extruded from the extruder, a feed roller and a pulling roller that are provided at a given interval so as to be able to come in rolling contact with the extruded material that is situated on the run-out table, and a cooling section that cools the extruded material between the feed roller and the pulling roller, wherein the feed roller and the pulling roller apply a tensile force to the extruded material while the extruded material advances from the feed roller to the pulling roller.

8 Claims, 5 Drawing Sheets

EXTRUSION APPARATUS

Japanese Patent Application No. 2016-020320 filed on Feb. 4, 2016, is hereby incorporated by reference in its entirety.

BACKGROUND

The present invention relates to an extrusion apparatus that includes an extruder that extrudes a light metal (e.g., aluminum, aluminum alloy, magnesium, and magnesium alloy), and accessory equipment.

An extrusion apparatus used for an aluminum alloy and the like is designed to preheat a cylindrical billet to a given temperature, introduce the billet into a container, and extrude the billet using an extruder (direct extruder or indirect extruder) to produce an extruded material.

The resulting extruded material is advanced along a run-out table.

Since the extruded material has been heated to a high temperature, a cooling table for cooling the extruded material is provided to the side of the run-out table.

Since the extruded material has been warped or distorted, for example, it is necessary to subject the extruded material to stretch leveling.

Therefore, a stretcher and a storage table are provided to the side of the cooling table.

The extruded material that has been subjected to stretch leveling is cut to have a given length using a cutting table provided to the side of the storage table, and placed on a rack.

As described above, a known extrusion apparatus includes an extruder and handling equipment (accessory equipment), and has a large size.

JP-A-10-277635 discloses an extrusion apparatus in which an extruder, a cooling device, a straightening device, and a sizing device are sequentially disposed in series so that the size of handling equipment is reduced.

However, the straightening device disclosed in JP-A-10-277635 compulsorily feeds the extruded material to a straightening roller using a drive roller, and does not subject the extruded material to stretch leveling.

SUMMARY

An object of the invention is to provide an extrusion apparatus that is effective for a reduction in size and space-saving, and achieves high productivity.

According to one aspect of the invention, there is provided an extrusion apparatus comprising:

an extruder;

a run-out table that supports an extruded material that has been extruded from the extruder;

a feed roller that is provided so as to be able to come in rolling contact with the extruded material that is situated on the run-out table;

a pulling roller that is provided at a given interval from the feed roller so as to be able to come in rolling contact with the extruded material that has been fed by the pulling roller on the run-out table and pulls the extruded material; and a cooling section that cools the extruded material at a position between the feed roller and the pulling roller, and applies a tensile force to the extruded material while the extruded material advances from the feed roller to the pulling roller.

The direction in which the extruded material is extruded from the extruder, and moved thereafter is referred to as "forward direction", and the verb "advance" may be used in connection therewith.

The run-out table is a table that supports the lower side of the extruded material that has been extruded (discharged) from the extruder. A plurality of support members may be provided to the upper side of the run-out table at given intervals.

The feed roller is a feeder that advances the extruded material.

The pulling roller is a puller that pulls (draws) the extruded material.

The cooling section cools the extruded material that has been heated to a high temperature. The cooling section may utilize water or air for cooling.

When the extruded material has an irregular cross-sectional shape (e.g., profile), it is preferable to use a cooling section that utilizes air since cross-sectional distortion (deformation) occurs to only a small extent.

When the extruded material that has been heated to a high temperature is cooled, the extruded material shrinks in the longitudinal direction in an area between the feed roller and the pulling roller, thereby a tensile force is applied to the extruded material (i.e., the extruded material is stretched).

Since it is preferable that the extrusion speed of the extruded material is high, it is preferable to set the air-cooling rate to 200 to 300° C./min or more.

The extrusion apparatus may further include a cutter that cuts the extruded material that has passed the pulling roller while moving in synchronization with the extrusion speed of the extruded material. The extrusion apparatus may also include a transfer section that advances the extruded material that has been cut.

This makes it possible to further reduce the size of the extrusion apparatus.

The extrusion apparatus may be configured so that the extruded material is cooled by the cooling section in an area between the feed roller and the pulling roller. In this case, since a shrinkage force due to cooling is applied to the extruded material in an area between the feed roller and the pulling roller, a tensile force is applied to the extruded material in an area between the feed roller and the pulling roller, so that the extruded material is stretched.

DESCRIPTION OF EXEMPLARY EMBODIMENTS

A configuration example of an extrusion apparatus and a method for producing an extruded material according to the exemplary embodiments of the invention are described below with reference to the drawings. Note that the invention is not limited to the exemplary embodiments described below.

Figure 1A:
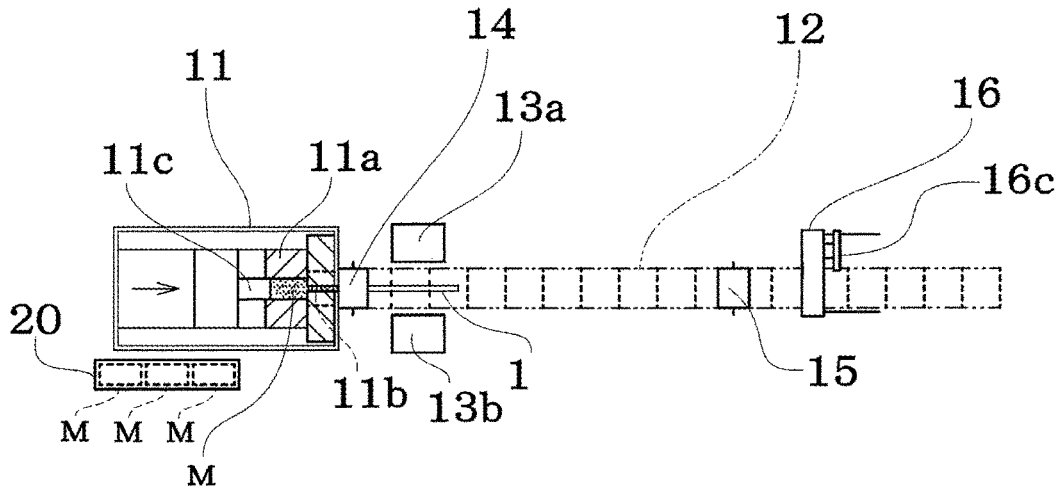
FIGS. 1A and 1B are respectively a plan view and a side view illustrating an initial extrusion state.
Figure 1B:
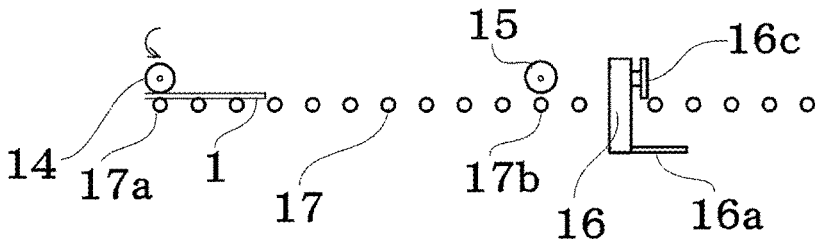

FIGS. 1A and 1B schematically illustrate an extrusion apparatus according to one embodiment of the invention.

The extrusion apparatus includes an extruder 11, and a run-out table 12 that supports an extruded material 1 that has been extruded from the extruder 11.

The extruder 11 includes a container 11*a* and a stem 11*c*, and an extrusion die 11*b* is placed in front of the container 11*a*.

In one embodiment of the invention, the extruder 11 is a direct extruder. Note that the extruder 11 may be an indirect extruder.

A cylindrical billet M that has been preheated to a high temperature using a heating furnace 20 is introduced into the container 11*a*, and the stem 11*c* is advanced to extrude the extruded material 1.

As schematically illustrated in FIG. 1A (plan view) and FIG. 1B (side view), the run-out table 12 includes a plurality of support members 17 that are provided at given intervals.

The support member 17 may be a bar material (member) that exhibits lubricity, or may be a rotatable support roller.

A feed roller (feeder) 14 and a pulling roller (puller) 15 are provided so as to be able to come in rolling contact with the extruded material 1 that is situated on the run-out table 12. The feed roller 14 is provided at a position close to the extruder 11. The pulling roller 15 is provided at a given distance from the feed roller 14.

Cooling sections 13*a* and 13*b* are provided at a position between the feed roller 14 and the pulling roller 15 so as to be situated on either side of the run-out table 12.

In one embodiment of the invention, the cooling sections 13*a* and 13*b* are air-cooling sections that strongly apply air to the extruded material 1 that has been extruded from the extruder 11.

Although FIG. 1A illustrates an example in which the cooling sections 13*a* and 13*b* (that make a pair) are provided at a position close to the feed roller 14, a plurality of pairs of cooling sections may be provided between the feed roller 14 and the pulling roller 15.

The cooling sections 13*a* and 13*b* may eject (discharge) air downward from the upper side of the run-out table 12.

The feed roller 14 advances the extruded material 1 that has been extruded from the extruder 11. In the example schematically illustrated in FIG. 1B, one feed roller 14 is provided opposite to one support roller 17*a*. When the extruded material 1 is a profile, a plurality of feed rollers 14 may be provided corresponding to the cross-sectional shape of the profile.

The pulling roller 15 pulls (draws) the extruded material. In the example schematically illustrated in FIG. 1B, one pulling roller 15 is provided opposite to one support roller 17*b*. Note that a plurality of pulling rollers 15 may be provided corresponding to the cross-sectional shape of the extruded material. The feed roller 14 is rotated at a speed that corresponds to the extrusion speed of the extruded material 1. The feed roller 14 may be a driven roller, or may be a drive roller that is driven by a drive motor or the like at a speed that corresponds to the extrusion speed.

The pulling roller 15 is a drive roller. The rotation of the pulling roller 15 is controlled by a drive motor or the like. The pulling roller 15 pulls (draws) the extruded material 1 at a speed equal to or higher than the extrusion speed.

A cutter 16 is provided in front of the pulling roller 15. The cutter 16 travels along a travel rail 16*a* that is provided parallel to the run-out table 12.

The cutter 16 has a blade 16*c* for cutting the extruded material 1. In one embodiment of the invention, a slide rail 16*b* is provided along which the blade 16*c* moves so as to cross the extruded material 1.

The extrusion speed at which the extruded material 1 is extruded is measured using a measurement section (e.g., encoder), and the cutter 16 cuts the extruded material 1 while traveling along the travel rail 16*a* in synchronization with the extrusion speed. The extruded material 1 is produced as described below.

As illustrated in FIG. 1A, the billet M that has been preheated using the heating furnace 20 is introduced into the container 11*a*, and extruded using the stem 11*c*.

Figure 2A:
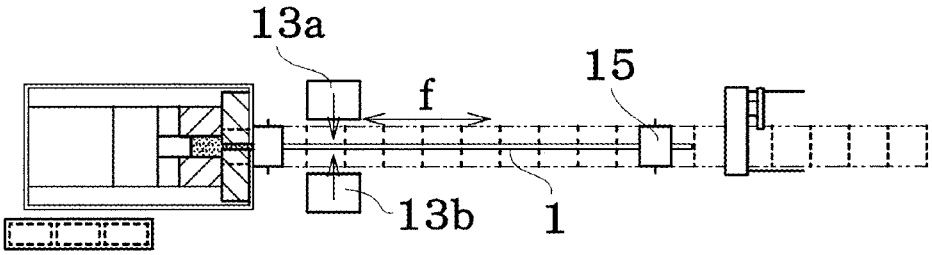
FIGS. 2A and 2B are respectively a plan view and a side view illustrating a state in which the end of an extruded material has passed a pulling roller, and a cooling section has been operated.
Figure 2B:
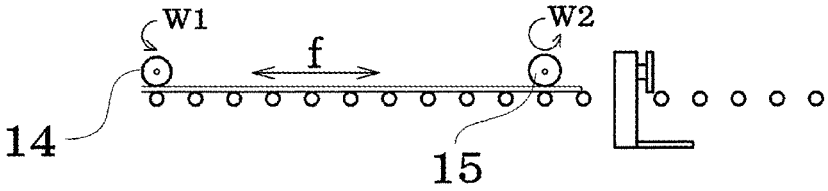

The extruded material 1 passes the feed roller 14, and the cooling sections 13*a* and 13*b* are operated in a state in which the end of the extruded material 1 has passed the pulling roller 15 (see FIGS. 2A and 2B).

The extruded material 1 shrinks due to cooling. Since the extruded material 1 advances while being held by the feed roller 14 and the pulling roller 15, a tensile force f illustrated in FIGS. 2A and 2B is applied to the extruded material 1 while the extruded material 1 shrinks in the longitudinal direction. Therefore, the extruded material 1 is stretched. In one embodiment of the invention, the tensile force f can be applied to the extruded material 1 by means of the cooling sections 13*a* and 13*b*, even when the feed roller 14 and the pulling roller 15 are rotated at an identical speed.

When rotating the feed roller 14, the rotation speed $W_2$ of the pulling roller 15 may be set to be higher than the rotation speed $W_1$ of the feed roller 14 so that the force in the tensile direction is ensured by the difference in rotation speed.

Figure 3A:
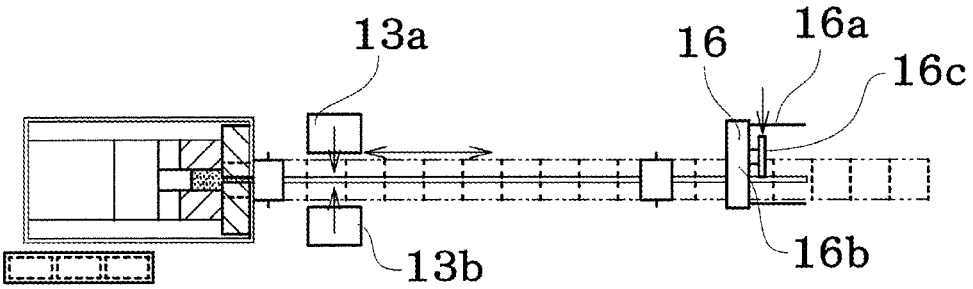
FIGS. 3A and 3B are respectively a plan view and a side view illustrating a state in which a cutter has been operated.
Figure 3B:
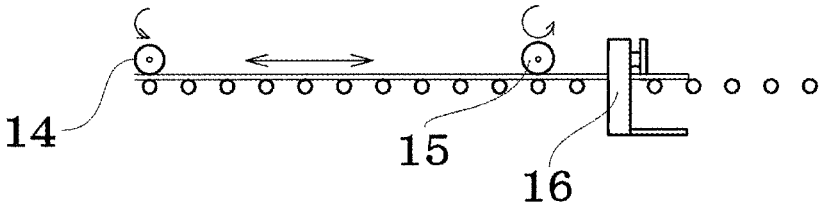
Figure 4A:
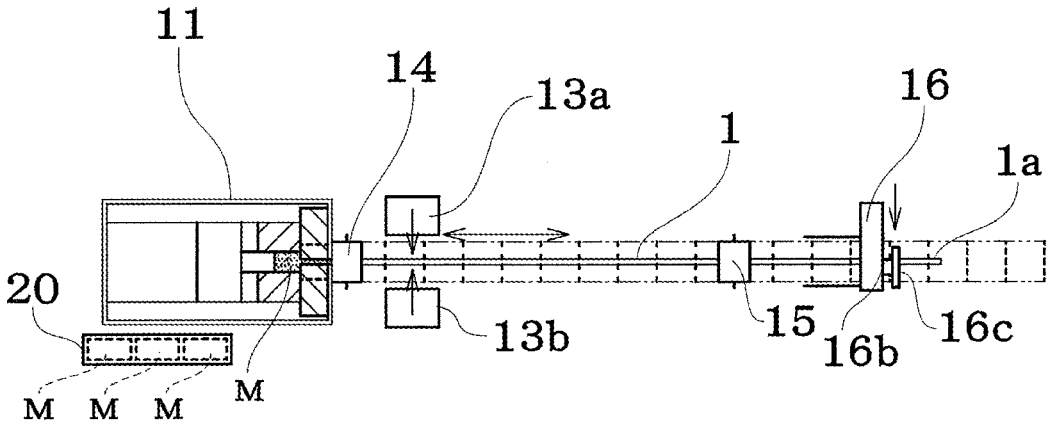
FIGS. 4A and 4B are respectively a plan view and a side view illustrating a state in which a cutter cuts an extruded material while traveling in synchronization with an extrusion speed.
Figure 4B:
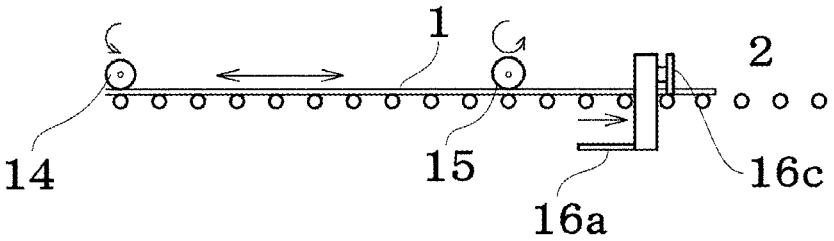

When the end of the extruded material 1 has passed the cutter 16 (see FIGS. 3A and 3B), the cutter 16 cuts the extruded material 1 while traveling along the travel rail 16*a* in synchronization with the extrusion speed of the extruded material 1 (see FIGS. 4A and 4B).

Figure 5A:
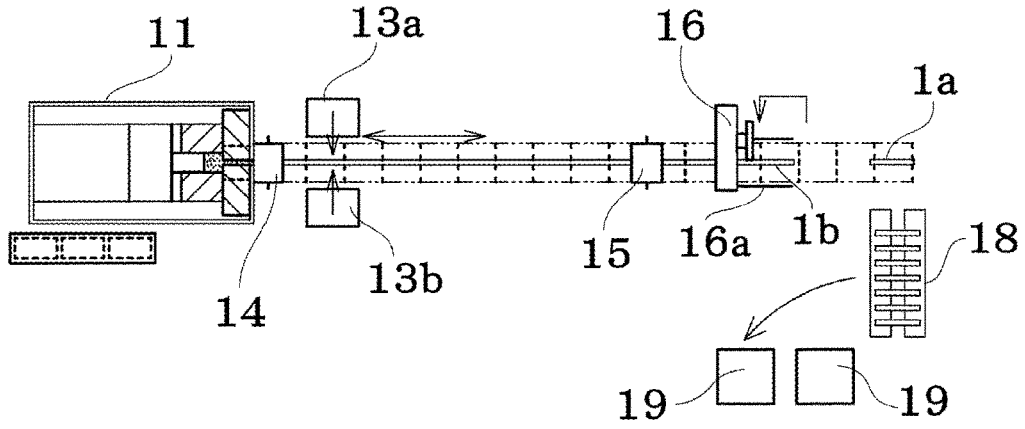
FIGS. 5A and 5B are respectively a plan view and a side view illustrating a state in which an extruded material that has been cut to have a given length is placed on a rack.
Figure 5B:
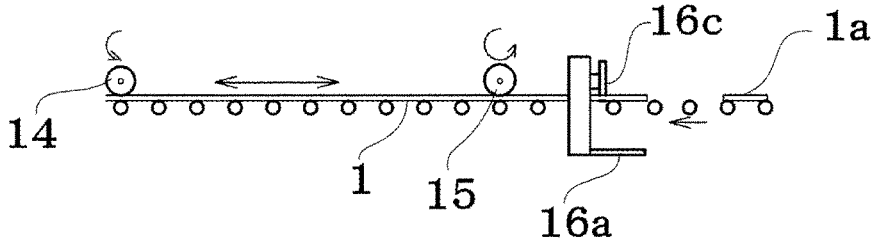

An extruded material la illustrated in FIG. 4A that has been cut is transferred forward by a transfer section (not illustrated in the drawings) at a speed higher than that of the extruded material 1, for example, and placed on a rack 19 through a temporary placement table 18 (see FIGS. 5A and 5B).

The cutter 16 is moved backward from the position illustrated in FIGS. 4A and 4B to the position illustrated in FIGS. 5A and 5B, and cuts the next extruded material 1*b*. The cutter 16 repeatedly cuts the extruded material 1 in this manner.

Although only some embodiments of the invention have been described in detail above, those skilled in the art will readily appreciate that many modifications are possible in the embodiments without materially departing from the novel teachings and advantages of the invention. Accordingly, all such modifications are intended to be included within scope of the invention.

What is claimed is:

1. An extrusion apparatus comprising:

an extruder;

a run-out table that supports an extruded material that has been extruded from the extruder;

a feed roller that is provided so as to be able to come in rolling contact with the extruded material that is situated on the run-out table;

a pulling roller that is provided at a given interval from the feed roller so as to be able to come in rolling contact with the extruded material that has been fed by the pulling roller on the run-out table and pulls the extruded material; and a cooling section that cools the extruded material at a position between the feed roller and the pulling roller and applies a tensile force to the extruded material while the extruded material advances from the feed roller to the pulling roller.

2. The extrusion apparatus as defined in claim 1, further comprising:

a cutter that cuts the extruded material that has passed the pulling roller while moving in synchronization with an extrusion speed of the extruded material.

3. The extrusion apparatus as defined in claim 2, further comprising:

a transfer section that advances the extruded material that has been cut.

4. The extrusion apparatus as defined in claim 3, wherein the transfer section advances the extruded material at a speed higher than the extrusion speed.

5. The extrusion apparatus as defined in claim 1, wherein the cooling section is an air-cooling section.

6. The extrusion apparatus as defined in claim 1, wherein the feed roller is a driven roller that is rotated by the extruded material that has been extruded from the extruder.

7. The extrusion apparatus as defined in claim 1, wherein the feed roller is a drive roller that feeds the extruded material at an extrusion speed of the extruded material.

8. The extrusion apparatus as defined in claim 7, wherein a rotation speed of the pulling roller is higher than a rotation speed of the feed roller.

* * * * *